US006789874B1

(12) United States Patent
Dietl

(10) Patent No.: US 6,789,874 B1
(45) Date of Patent: Sep. 14, 2004

(54) METHOD OF CLEANING NOZZLES IN INKJET PRINTHEAD

(75) Inventor: Steven J. Dietl, Ontario, NY (US)

(73) Assignee: Eastman Kodak Company, Rochester, NY (US)

( * ) Notice: Subject to any disclaimer, the term of this patent is extended or adjusted under 35 U.S.C. 154(b) by 19 days.

(21) Appl. No.: 10/376,560

(22) Filed: Feb. 28, 2003

(51) Int. Cl.[7] ..... B41J 2/165

(52) U.S. Cl. ..... 347/22; 347/29; 347/30; 347/87

(58) Field of Search ..... 347/22, 24, 28–35, 347/84–87, 92

(56) References Cited

U.S. PATENT DOCUMENTS

| | | | | |
|---|---|---|---|---|
| 4,509,062 A | | 4/1985 | Low et al. | |
| 5,382,969 A | * | 1/1995 | Mochizuki et al. | 347/23 |
| 5,650,811 A | | 7/1997 | Seccombe et al. | |
| 5,821,954 A | * | 10/1998 | Imai et al. | 347/35 |
| 6,036,299 A | * | 3/2000 | Kobayashi et al. | 347/30 |
| 6,315,468 B2 | * | 11/2001 | Kishida et al. | 400/55 |
| 6,499,825 B2 | * | 12/2002 | Suzuki | 347/35 |
| 6,709,088 B2 | * | 3/2004 | Hayakawa et al. | 347/31 |

* cited by examiner

*Primary Examiner*—Shih-Wen Hsieh
(74) *Attorney, Agent, or Firm*—Roger A. Fields

(57) ABSTRACT

A method of cleaning spaced nozzles in a printhead of a drop-on-demand inkjet printer in which a slight negative pressure is desired in an ink reservoir in order to prevent ink drool from the nozzles, comprises: deforming a compliant pressure regulator membrane that covers an opening in an ink reservoir, inwardly at the opening, to decrease the ink holding volume of the reservoir; deforming a compliant valve membrane that covers an opening in the ink reservoir and caps an ink conduit projecting into the reservoir, outwardly at the opening and away from the ink conduit, to uncap the ink conduit in order that the ink conduit can provide ink delivery at a positive pressure into the reservoir and out through the nozzles to clean the nozzles; returning the compliant valve membrane inwardly towards the ink conduit to recap the ink conduit in order to terminate ink delivery into the reservoir; and returning the compliant pressure regulator membrane outwardly to increase the ink holding volume of the reservoir in order to reduce ink pressure in the reservoir. Also, the method can further comprise: ejecting some ink from the nozzles by activating thermal or piezoelectric activators for the nozzles, in order to ensure a slight negative pressure in the reservoir.

6 Claims, 5 Drawing Sheets

METHOD OF CLEANING NOZZLES IN INKJET PRINTHEAD

CROSS-REFERENCE TO RELATED APPLICATION

Reference is made to commonly assigned, copending application Ser. No. 10/373,257 entitled INK DELIVERY APPARATUS FOR INKJET PRINTHEAD and filed Feb. 24, 2003 in the name of Steven J. Dietl.

FIELD OF THE INVENTION

The invention generally relates to inkjet printers, and more particularly to a method of cleaning nozzles in an inkjet printhead.

BACKGROUND OF THE INVENTION

Inkjet printers can be divided into two major categories, commonly referred to as continuous inkjet and drop-on-demand (DOD) inkjet.

In DOD inkjet printers, printing ink droplets are discharged from closely spaced nozzles in a printhead and onto a printing medium such as paper. Typically, the ink droplets are formed via thermal or piezoelectric activators, sometimes referred to as "firing devices". With thermal activators, thin-film resistors or other type heater elements can be located in small firing chambers for the nozzles. When an electrical printing pulse heats a heater element, a vapor or gas bubble is formed between it and the nozzle inside the firing chamber. The bubble forces an ink droplet to be ejected from the nozzle. Then, when the heater element cools, the bubble collapses, and replenishment ink is drawn into the firing chamber due to the capillary attraction of the ink to the nozzle. With piezoelectric actuators, piezoelectric crystals or other piezoelectric elements can be located in the firing chambers. When an electrical printing pulse stimulates the piezoelectric element, it is mechanically actuated to cause an ink droplet to be expelled from the nozzle.

The ink delivery apparatus for the printhead in a DOD inkjet printer delivers very small quantities of the ink to the firing chambers in the printhead at a slight negative pressure or vacuum known as a "back pressure". The slight negative pressure is desired because it prevents the ink from leaking, i.e. drooling, out of the nozzles by tending to draw the ink at the nozzles back into the firing chambers. Moreover, it forms a slightly concave ink meniscus at each nozzle which helps to keep the nozzle clean. Typically, as stated in prior art U.S. Pat. No. 5,650,811 issued Jul. 22, 1997, the slight negative pressure in the printhead may be approximately two to three inches of water below atmospheric pressure. The patent also states that the slight negative pressure can be created by positioning an ink reservoir for the printhead below the printhead. Alternatively, the slight negative pressure can be created by using a nonlinear spring to pull a compliant membrane outward at an opening in an ink reservoir above the printhead. This latter approach is described in detail in U.S. Pat. No. 4,509,062 issued Apr. 2, 1985.

A known problem with DOD inkjet printers is that dirt or dried ink can accumulate over time in the nozzles. Before this occurs, the nozzles should be cleaned such as by flushing the ink or a cleaning solvent under positive pressure outwardly through the nozzles. Otherwise, the dirt or dried ink can cause the ink droplets ejected from the nozzles to be misdirected with respect to the printing trajectories that the ink droplets should normally take. Such misdirection can cause the printed image to be of a lesser quality.

The Cross-Referenced Application

The cross-referenced application discloses a DOD inkjet printer in which an ink reservoir is positioned atop the printhead to provide ink delivery at a slight negative pressure to the printhead. A pressure regulator and ink replenishment mechanism maintains the slight negative pressure in the reservoir during ink delivery to the printhead, and in response to ink delivery provides comparable ink replenishment to the reservoir from an ink conduit projecting into the reservoir. The mechanism includes a compliant pressure regulator membrane that covers a wall opening in the reservoir and is connected via a rocker lever outside the reservoir to a compliant valve membrane that covers a different opening in the reservoir and normally caps the ink conduit to prevent ink replenishment to the reservoir. Ink delivery from the reservoir to the printhead causes the pressure regulator membrane to deform inwardly at the wall opening to decrease the holding volume of the reservoir, in turn to forward-pivot the rocker lever to deform the valve membrane outwardly at the other opening to uncap the ink conduit in order to initiate ink replenishment to the reservoir. When ink is replenished to the reservoir, the pressure regulator membrane returns outwardly to increase the holding volume of the reservoir, in turn to reverse-pivot the rocker lever to return the valve membrane inwardly to recap the ink conduit in order to terminate ink replenishment. The pressure regulator membrane maintains the slight negative pressure in the reservoir by being able to deform inwardly during ink delivery to the printhead and to return outwardly during ink replenishment to the reservoir.

SUMMARY OF THE INVENTION

A method of cleaning spaced nozzles in a printhead of a drop-on-demand inkjet printer in which a slight negative pressure is desired in an ink reservoir in order to prevent ink drool from the nozzles, comprising:

deforming a compliant pressure regulator membrane that covers an opening in an ink reservoir, inwardly at the opening, to decrease the ink holding volume of the reservoir;

deforming a compliant valve membrane that covers an opening in the ink reservoir and caps an ink conduit projecting into the reservoir, outwardly at the opening and away from the ink conduit, to uncap the ink conduit in order that the ink conduit can provide ink delivery at a positive pressure into the reservoir and out through the nozzles to clean the nozzles;

returning the compliant valve membrane inwardly towards the ink conduit to recap the ink conduit in order to terminate ink delivery into the reservoir; and returning the compliant pressure regulator membrane outwardly to increase the ink holding volume of the reservoir in order to reduce ink pressure in the reservoir.

Also, the method can further comprise:

ejecting some ink from the nozzles by activating thermal or piezoelectric activators for the nozzles, when the compliant valve membrane has returned to recap the ink conduit, and not before the compliant pressure regulator membrane has returned outwardly to increase the ink holding volume of the reservoir,in order to ensure a slight negative pressure in the reservoir which prevents ink drool from the nozzles.

DETAILED DESCRIPTION OF THE INVENTION

The invention is depicted as embodied in a drop-on-demand (DOD) inkjet printer. Because the features of such a printer are generally known, the description which follows is directed in particular only to those elements forming part of or cooperating with the disclosed embodiment of the invention. It is to be understood, however, that other elements not disclosed may take various forms known to a person of ordinary skill in the art.

The Cross-Referenced Application

Figure 1:
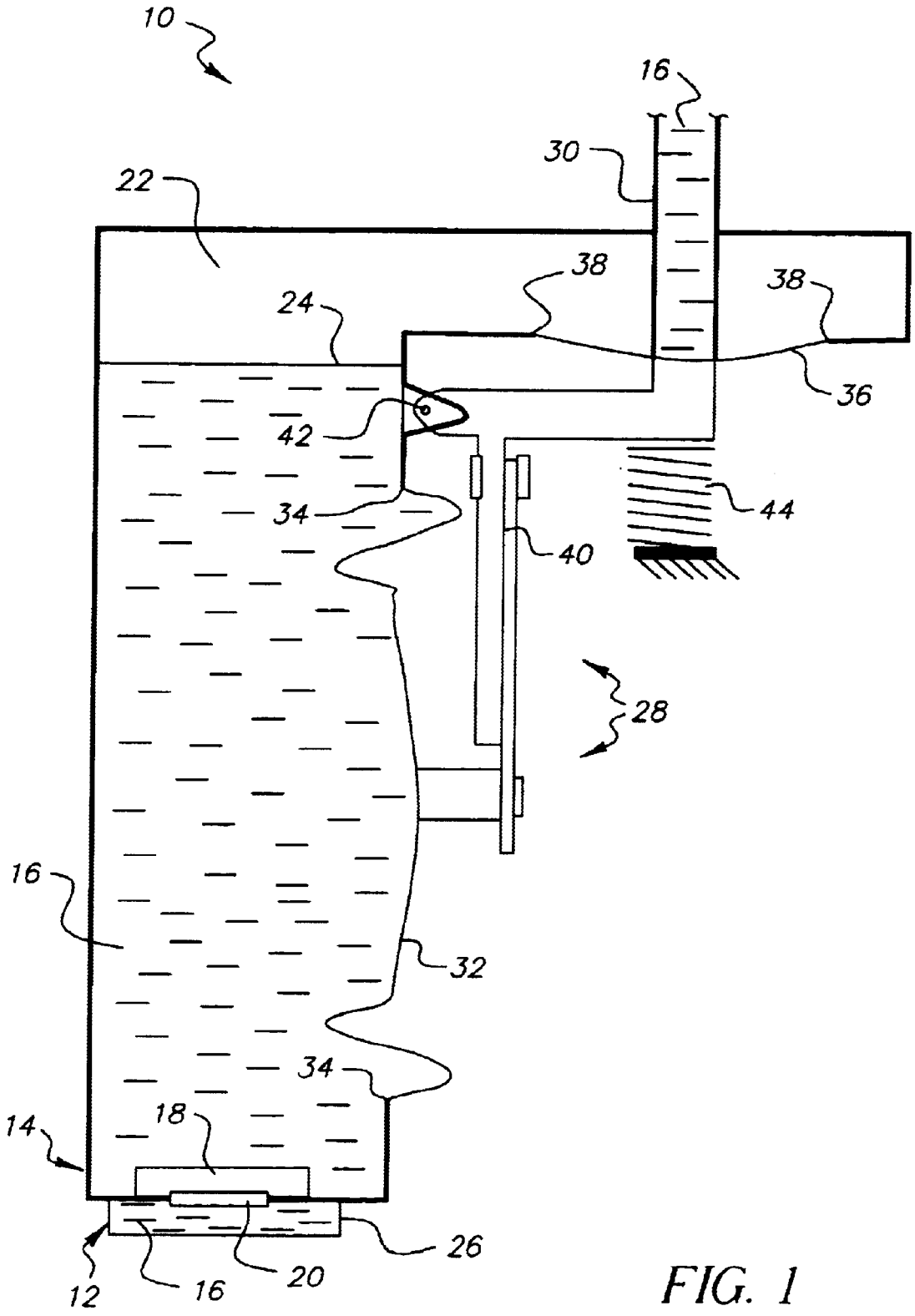
FIGS. 1 and 2 are elevation views, partly in section, of a DOD inkjet printer having an ink delivery apparatus similar to the one disclosed in the cross-referenced application.
Figure 2:
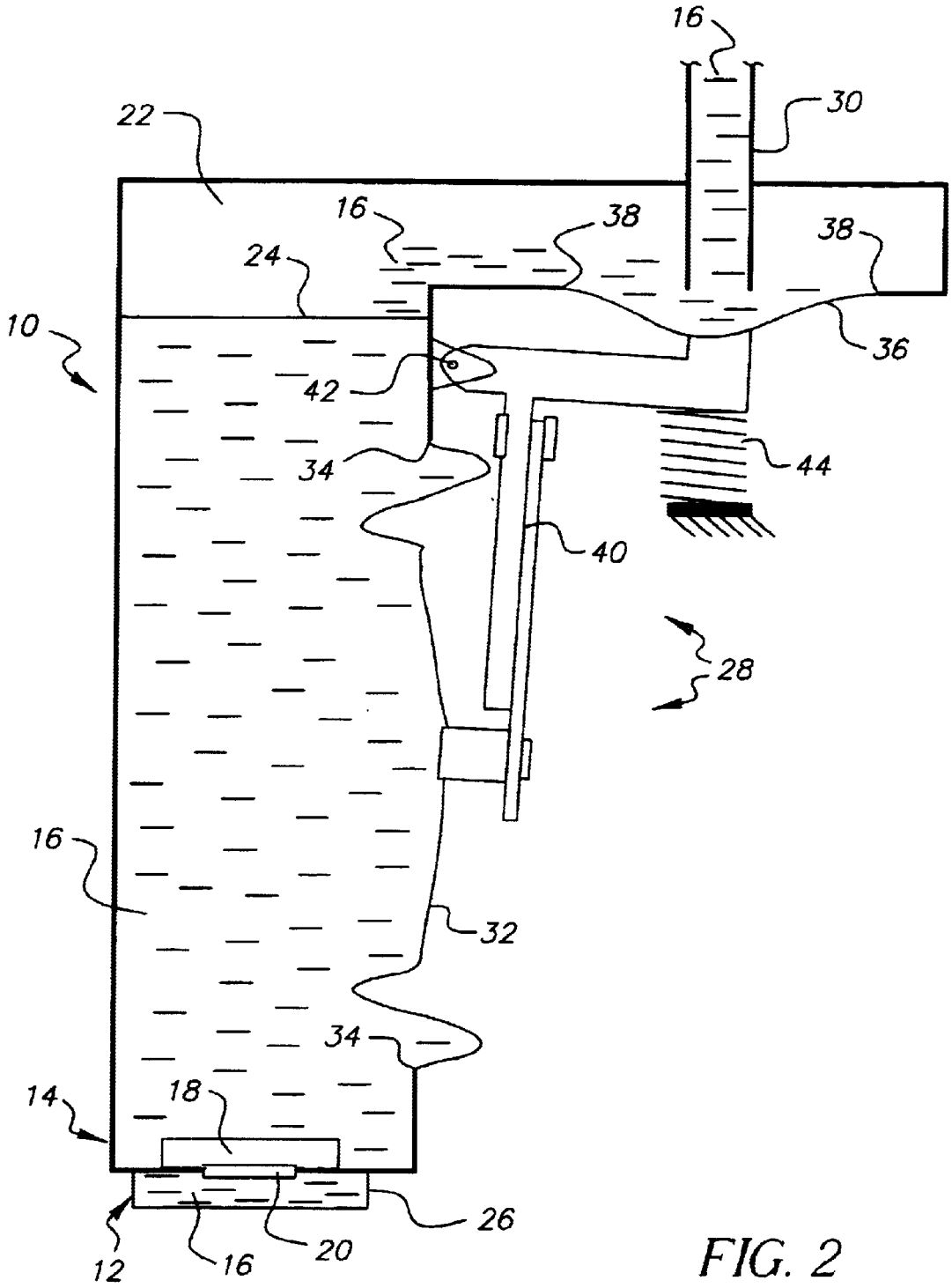

FIGS. 1 and 2 shows an ink delivery apparatus 10 for an DOD inkjet printhead 12 substantially similar to the one disclosed in the cross-referenced application.

The ink delivery apparatus 10 includes a closed ink reservoir or ink accumulating chamber 14 fixed atop the printhead 12. An ink 16 in the reservoir 14 is intended to drain in very small quantities first through a filter 18 and then through a bottom slot 20, and into the printhead 12. A slight-vacuum airspace 22, i.e. one that is slightly below atmospheric pressure, exists above the ink level 24 in the reservoir 14. This is consistent with the known need to deliver the ink 16 to the printhead 12 at a slight negative pressure known as a "back pressure". Typically, as stated in prior U.S. Pat. No. 5,650,811 issued Jul. 22, 1997, the slight negative pressure in the reservoir 14 and the printhead 12 may be approximately two to three inches of water below atmospheric pressure. The slight negative pressure is desired because it prevents the ink 16 from leaking, i.e. drooling, out of closely spaced ink discharge nozzles (not shown in FIGS. 1 and 2) in a nozzle plate 26 in the printhead 12, by tending to draw the ink at the nozzles back into the printhead. Moreover, it forms a slightly concave ink meniscus at each nozzle which helps to keep the nozzle clean.

A pressure regulator and ink replenishment mechanism 28 maintains the slight negative pressure in the reservoir 14 during delivery of the ink 16 in very small quantities to the printhead 12 from the reservoir, and in response to the ink delivery provides ink replenishment in similar quantities to the reservoir from a positive pressure ink supply source (not shown) that is in fluid communication with an ink conduit 30 such as a tube which projects into the reservoir. See FIGS. 1 and 2.

The pressure regulator and ink replenishment mechanism 28 includes a pressure regulator membrane or diaphragm 32 that air-tightly covers a wall opening 34 in the reservoir 14. The pressure regulator membrane 32 is compliant in order to maintain the slight negative pressure in the reservoir 14 by deforming inwardly at the wall opening 34 as shown in FIG. 2, to decrease the holding volume of the reservoir, during ink delivery from the reservoir to the printhead 12, and by returning outwardly at the wall opening as shown in FIG. 1 to increase the holding volume of the reservoir, during ink replenishment to the reservoir via the ink conduit 30. Also, the mechanism 28 includes a valve membrane or diaphragm 36, much smaller than the pressure regulator membrane 32, that air-tightly covers another opening 38 in the reservoir 14 and normally caps or closes the ink conduit 30 to prevent ink replenishment to the reservoir. See FIG. 1. The valve member 36 is compliant to be deformed outwardly at the other opening 38 and away from the ink conduit 30 to uncap or open the ink conduit as shown in FIG. 2, in order to initiate ink replenishment to the reservoir 14, and to return inwardly towards the ink conduit to recap the ink conduit as shown in FIG. 1, in order to terminate ink replenishment to the reservoir.

A rocker lever 40, located outside the reservoir 14 to avoid being exposed to the ink 16, is pivotally mounted via a pivot pin 42 on the reservoir and intereconnects the pressure regulator membrane 32 and the valve membrane 36. Ink delivery from the reservoir 14 to the printhead 12 causes the pressure regulator membrane 32 to deform inwardly to decrease the holding volume of the reservoir as shown in FIG. 2, in turn to simultaneously forward (clockwise)-pivot the rocker lever 40 to deform the valve membrane 36 outwardly to uncap the ink conduit 30 in order to initiate ink replenishment to the reservoir. When the ink 16 is replenished to the reservoir 14, the pressure regulator membrane 32 returns outwardly to increase the holding volume of the reservoir as shown in FIG. 1, in turn to reverse (counterclockwise)-pivot the rocker lever 40 to return the valve membrane 36 outwardly to recap the ink conduit 30 in order to terminate ink replenishment to the reservoir.

A helical compression spring 44 applies a counterclockwise pivoting force in FIG. 1 to the rocker lever 40 that causes the rocker lever to lightly hold the valve membrane 36 capping the ink conduit 30. The pivoting force is light enough to be readily overcome when the pressure regulator membrane 32 deforms inwardly as shown in FIG. 2.

The Method Of Cleaning The Nozzles

Figure 3:
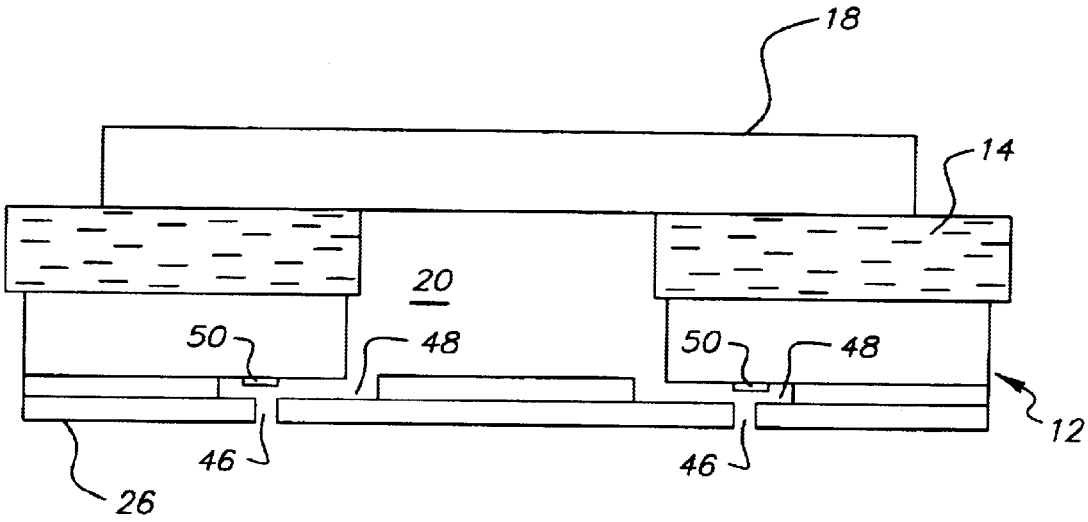
FIG. 3 is an elevation view, partly in section, of a printhead in the DOD inkjet printer.

FIG. 3 shows the printhead 12, including closely spaced nozzles 46 in the nozzle plate 26 and respective firing chambers 48 for the nozzles. Each firing chamber 48 has a known thermal or piezoelectric activator 50 which when activated by an electrical printing pulse causes a printing ink droplet to be ejected from the nozzle and onto a printing medium (not shown).

Figure 4:
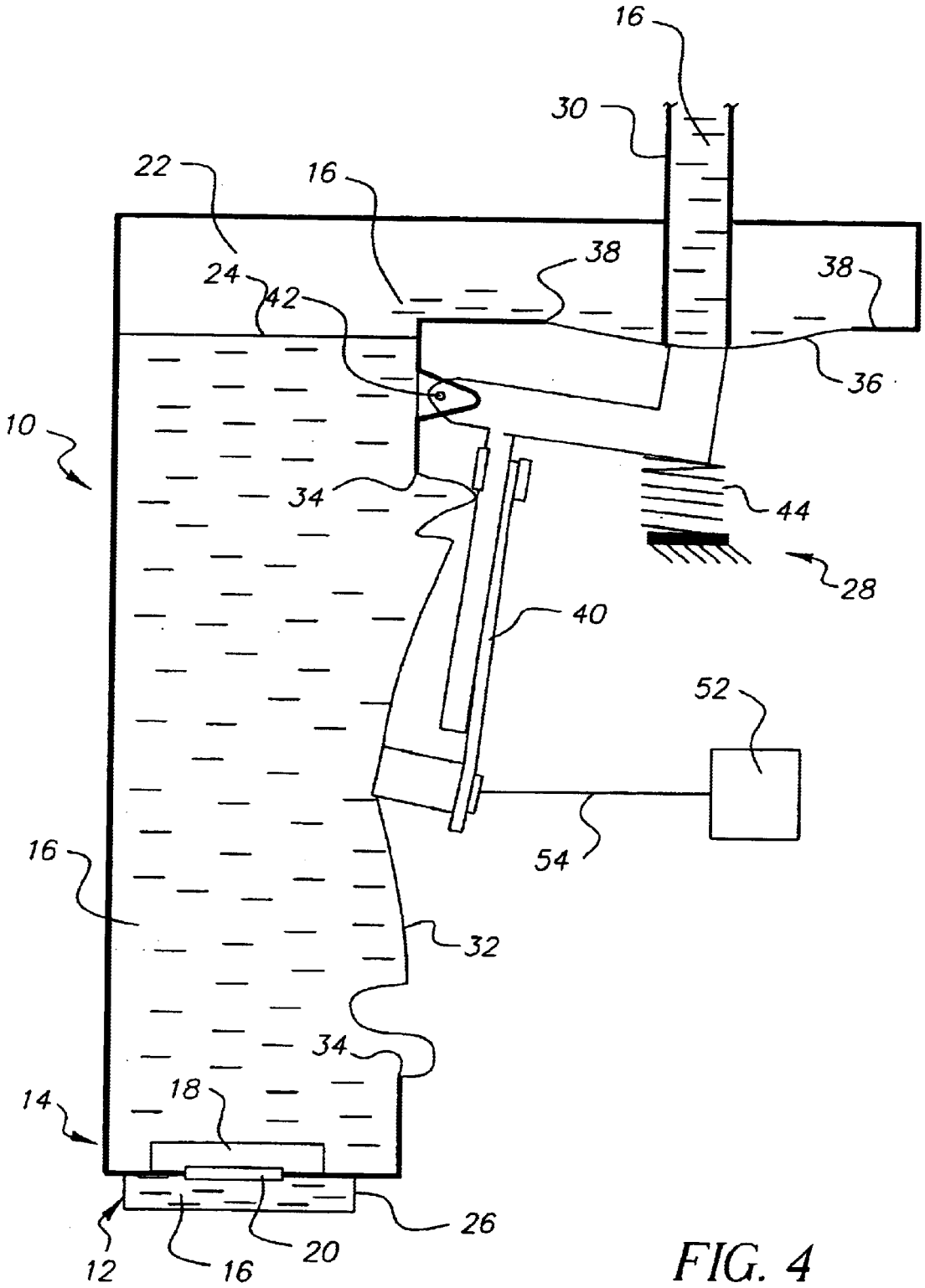
FIGS. 4 and 5 are elevation views, partly in section of the DOD inkjet printer, partially modified to illustrate a method of cleaning the nozzles in the printhead according to a preferred embodiment of the invention.
Figure 5:
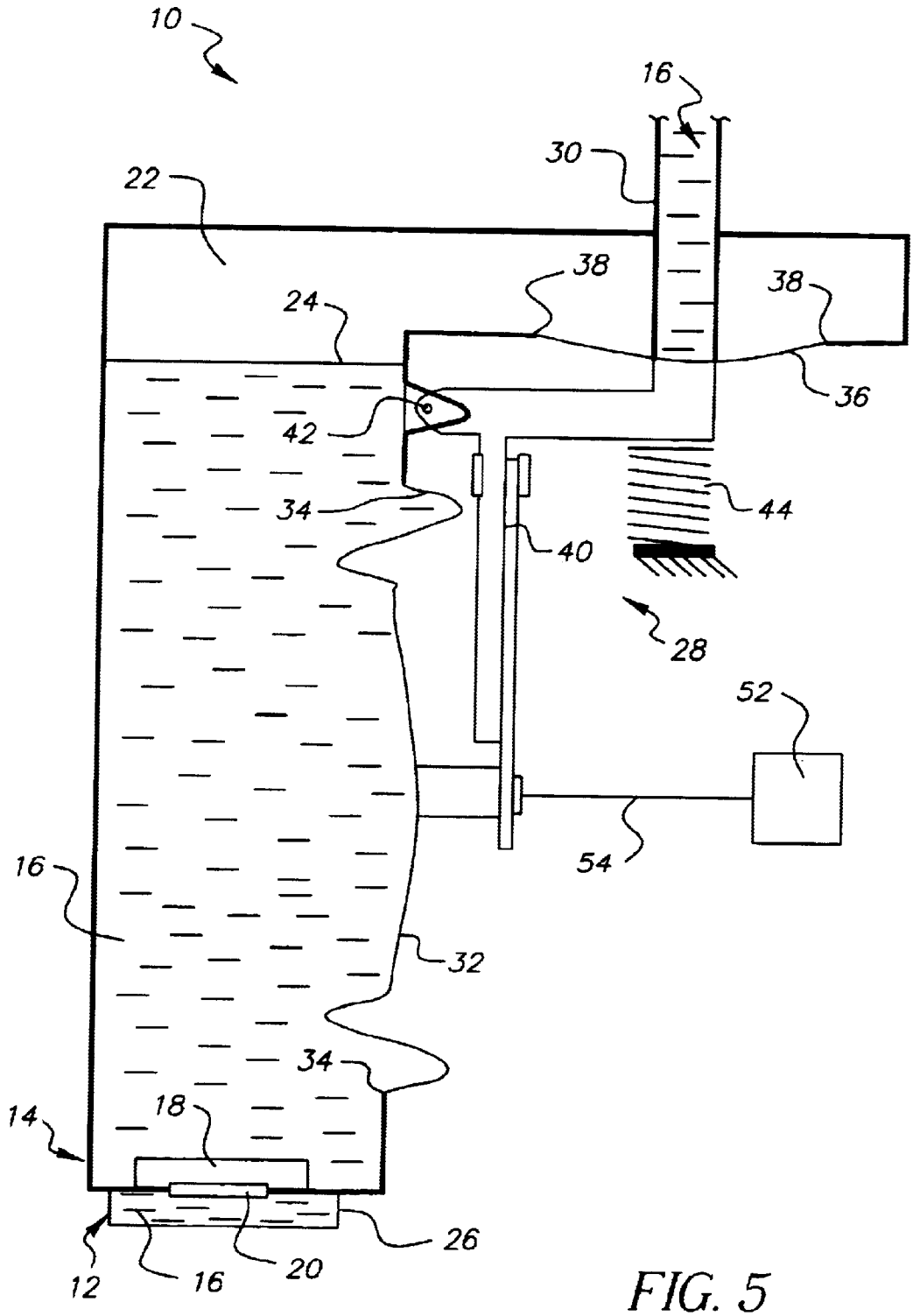

A method of cleaning the nozzles 46 using the ink 16 is shown in FIGS. 4 and 5. FIGS. 4 and 5 depict the ink delivery apparatus 10 partially modified to illustrate the nozzle cleaning method according to a preferred embodiment of the invention.

In FIG. 4, a solenoid 52 or other known mechanical actuator is energized to move a plunger 54 of the solenoid to the left. The plunger 54 then forward-pivots the rocker lever 40 about the pivot pin 42 to deform the compliant pressure regulator membrane 32 that covers the wall opening 34 in the ink reservoir 14, inwardly at the wall opening, to decrease the ink holding volume of the reservoir. Also, the compliant valve membrane 36 that covers the other opening 38 in the ink reservoir and caps the ink conduit 30 projecting into the reservoir, is deformed outwardly at the other opening and away from the ink conduit, to uncap the ink conduit in order that the ink conduit can provide ink delivery at a positive pressure into the reservoir and out through the nozzles 46 to clean the nozzles.

After a sufficient time has elapsed for nozzle cleaning, as may be determined by a timer (not shown) for example, the solenoid 52 is de-energized to retract the plunger 54 to the right in FIG. 5, to separate the plunger from the rocker lever 40. The spring 44 then reverse-pivots the rocker lever 40 about the pivot pin 42 to return the compliant valve membrane 36 inwardly towards the ink conduit 30 to recap the ink conduit in order to terminate ink delivery into the reservoir 14. Also, the compliant pressure regulator membrane 32 is deformed outwardly to increase the ink holding volume of the reservoir 14 in order to reduce ink pressure in the reservoir.

When the valve membrane 36 has returned inwardly to recap the ink conduit 30, but not before the pressure regulator membrane 32 has returned outwardly to increase the holding volume of the reservoir 14, the thermal or piezoelectric activators 50 are activated numerous times, e.g. 2000 times, to cause very small quantities of the ink 16 to be ejected from the nozzles 46. This ensures that a slight negative pressure is created in the reservoir 14 to prevents ink drool from the nozzles 46. However, this step is not necessarily a mandatory one since the step of deforming the compliant pressure regulator membrane 32 outwardly to increase the ink holding volume of the reservoir 14 may be sufficient to effect a slight negative pressure in the reservoir 14.

The solenoid 52 with the plunger 54 may be wheeled away from the ink delivery apparatus 10 during its operation as shown in FIGS. 1 and 2.

The invention has been described in detail with particular reference to certain preferred embodiments thereof, but it will be understood that variations and modifications can be effected within the spirit and scope of the invention. For example, the solenoid 52 could be replaced by manual intervention.

PARTS LIST

10. ink delivery apparatus
12. inkjet printhead
14. ink reservoir
16. ink
18. filter
20. bottom slot
22. airspace
24. ink level
26. nozzle plate
28. pressure regulator and ink replenishment mechanism
30. ink conduit
32. pressure regulator membrane
34. wall opening
36. valve membrane
38. other opening
40. rocker lever
42. pivot pin
44. spring
46. nozzles
48. firing chamber
50. thermal or piezoelectric activators
52. solenoid
54. plunger

What is claimed is:

1. A plasma injector assembly for use in a munition having a central axis, the plasma injector assembly comprising:

a stub case for attachment to the munition along the central axis;

an anode positioned in the stub case;

a cathode positioned in the stub case, wherein the anode and the cathode are located at opposite ends of a plasma creation region, wherein the plasma creation region is aligned along a planar depth that is substantially transverse to the central axis; and a vent assembly disposed between the plasma creation region and a propellant region.

2. The plasma injector assembly of claim 1, and further comprising a conductive wire that interconnects the anode and the cathode.

3. The plasma injector assembly of claim 1, wherein the plasma injector assembly has a tube with a first end and a second end, wherein the anode is placed in the first end, wherein the cathode is placed in the second end, and wherein the tube has at least one aperture formed therein such that a region inside the tube is in communication with the vent assembly.

4. The plasma injector assembly of claim 3, wherein the plasma injector assembly substantially ignites the propellant within about 1–2 milliseconds.

5. The plasma injector assembly of claim 1, wherein the plasma injector assembly produces plasma that is directed into the propellant region by a plurality of apertures in the vent assembly.

6. A plasma injector assembly for use in a munition having a central axis, the plasma injector comprising:

a stub case for attachment to the munition along the central axis;

a tube having a first end and a second end, wherein the tube has a central bore extending therethrough, wherein the tube has at least one aperture that is operably connected to the central bore, and wherein the tube is mounted to the stub case in an orientation that is substantially transverse to the central axis;

an anode positioned proximate the first end;

a cathode positioned proximate the second end;

a conductive wire extending through the central bore between the anode and the cathode and operably connecting the anode and the cathode; and a vent assembly having an aft end and a forward end wherein the aft end is in communication with the tube and a forward end is in communication with a propellant.

* * * * *

UNITED STATES PATENT AND TRADEMARK OFFICE

CERTIFICATE OF CORRECTION

PATENT NO. : 6,789,874 B1
DATED : September 14, 2004
INVENTOR(S) : Steven J. Dietl It is certified that error appears in the above-identified patent and that said Letters Patent is hereby corrected as shown below:

Column 6,
Lines 1-52, replace the claims with the following claims:

1. A method of cleaning spaced nozzles in a printhead of a drop-on-demand inkjet printer in which a slight negative pressure is desired in an ink reservoir in order to prevent ink drool from the nozzles, said method comprising:

deforming a compliant pressure regulator membrane that covers an opening in an ink reservoir, inwardly at the opening, to decrease the ink holding volume of the reservoir;

deforming a compliant valve membrane that covers an opening in the ink reservoir and caps an ink conduit projecting into the reservoir, outwardly at the opening and away from the ink conduit, to uncap the ink conduit in order that the ink conduit can provide ink delivery at a positive pressure into the reservoir and out through the nozzles to clean the nozzles;

returning the compliant valve membrane inwardly towards the ink conduit to recap the ink conduit in order to terminate ink delivery into the reservoir; and returning the compliant pressure regulator membrane outwardly to increase the ink holding volume of the reservoir in order to reduce ink pressure in the reservoir.

2. A method as recited in claim 1, further comprising:

ejecting some ink from the nozzles by activating thermal or piezoelectric activators for the nozzles, when the compliant valve membrane has returned inwardly to recap the ink conduit, and not before the compliant pressure regulator membrane has returned outwardly to increase the ink holding volume of the reservoir, in order to ensure a slight negative pressure in the reservoir which prevents ink drool from the nozzles.

3. A method as recited in claim 1, further comprising:

forward-pivoting a rocker lever interconnecting the compliant valve membrane and the compliant pressure regulator membrane to deform the compliant pressure regulator membrane inwardly to decrease the ink holding volume of the reservoir and deform the compliant valve membrane outwardly to uncap the ink conduit.

4. A method as recited in claim 3, wherein the rocker lever is reverse-pivoted to return the compliant pressure regulator membrane outwardly to increase the ink holding volume of the reservoir and return the compliant valve membrane inwardly to recap the ink conduit.

5. A method of cleaning spaced nozzles in a printhead of a drop-on-demand inkjet printer in which a slight negative pressure is desired in an ink reservoir in order to prevent ink drool from the nozzles, said method comprising:

deforming a compliant pressure regulator membrane that covers a wall opening in an ink reservoir, inwardly at the wall opening, to decrease the ink holding volume of the reservoir, and deforming a compliant valve membrane that covers another opening in the ink reservoir and caps an ink conduit projecting into the reservoir, outwardly at the other opening and away from the ink conduit, to uncap the ink conduit in order that the ink

UNITED STATES PATENT AND TRADEMARK OFFICE

CERTIFICATE OF CORRECTION

PATENT NO. : 6,789,874 B1
DATED : September 14, 2004
INVENTOR(S) : Steven J. Dietl It is certified that error appears in the above-identified patent and that said Letters Patent is hereby corrected as shown below:

Column 6 (cont'd), conduit can provide ink delivery at a positive pressure into the reservoir and out through the nozzles to clean the nozzles, by forward-moving a connection member interconnecting the compliant valve membrane and the compliant pressure regulator membrane;

returning the compliant valve membrane inwardly towards the ink conduit to recap the ink conduit in order to terminate ink delivery into the reservoir, and returning the compliant pressure regulator membrane outwardly to increase the ink holding volume of the reservoir in order to reduce ink pressure in the reservoir, by reverse-moving the connection member; and ejecting some ink from the nozzles in order to ensure a slight negative pressure in the reservoir which prevents ink drool from the nozzles.

6. A method as recited in claim 5, wherein some ink is ejected from the nozzles in order to ensure a slight negative pressure in the reservoir by activating a thermal or piezoelectric activators for the nozzles.

Signed and Sealed this

Seventh Day of February, 2006

JON W. DUDAS
*Director of the United States Patent and Trademark Office*